US006729963B2

(12) United States Patent
Hlynka

(10) Patent No.: US 6,729,963 B2
(45) Date of Patent: May 4, 2004

(54) UNDULATING AMUSEMENT SLIDE

(75) Inventor: Marvin Hlynka, Richmond (CA)

(73) Assignee: Whitewater West Industries Inc., Richmond (CA)

( * ) Notice: Subject to any disclaimer, the term of this patent is extended or adjusted under 35 U.S.C. 154(b) by 0 days.

(21) Appl. No.: 10/299,585

(22) Filed: Nov. 18, 2002

(65) Prior Publication Data

US 2003/0139218 A1 Jul. 24, 2003

Related U.S. Application Data

(60) Provisional application No. 60/334,474, filed on Nov. 16, 2001.

(51) Int. Cl.[7] ..... A63G 21/18
(52) U.S. Cl. ..... 472/117; 472/128
(58) Field of Search ..... 472/116, 117, 472/128; 104/53, 69, 70

(56) References Cited

U.S. PATENT DOCUMENTS 5,011,134 A * 4/1991 Langford ..... 472/117
5,137,497 A * 8/1992 Dubeta ..... 472/88
6,354,955 B1 * 3/2002 Stuart et al. ..... 472/117
6,450,891 B1 * 9/2002 Dubeta ..... 472/117

OTHER PUBLICATIONS

"Sidewinder MKII/Typical Plan Layout," Waterfun Products Inc., Sylvan Lake, Alberta, Canada, dated Jan. 29, 1994, one (1) page advertising blueprint.

* cited by examiner

*Primary Examiner*—Kien Nguyen
(74) *Attorney, Agent, or Firm*—Christensen O'Connor, Johnson Kindness PLLC

(57) ABSTRACT

A rider slides down an inlet slide to a low entrance opening of a separate exit slide. The exit slide has an inclined portion along which the rider decelerates from the entrance as he or she moves upward, followed by downward travel along a predetermined path of the separate exit slide from a high elevation, past the entrance, to a low elevation.

13 Claims, 4 Drawing Sheets

UNDULATING AMUSEMENT SLIDE

CROSS-REFERENCE TO RELATED APPLICATION

This application claims the benefit of U.S. Provisional Patent Application No. 60/334,474, filed on Nov. 16, 2001 now abandoned.

FIELD OF THE INVENTION

The present invention pertains to amusement slides, particularly water slides.

BACKGROUND OF THE INVENTION

In known water slides, a user typically coasts along a slippery surface from a higher elevation to a lower elevation, either in a straight line path or a path that includes curves. A water slide may take the form of a flume in which a large volume of water is introduced at the entry for lubricating the surface of the slide and for assisting in moving the user along the flume, and/or one or more sections that are misted with water to maintain the slippery characteristic of the slide surface. Sometimes the user will sit or lie on a mat or ride in a vehicle designed to coast along a predefined route. Water slides typically terminate at an exit pool.

SUMMARY OF THE INVENTION

The present invention provides an amusement device in the nature of a slide having a long predetermined path along its length from a high elevation at a first end portion thereof to a lower elevation at a second end portion thereof. The slide has a rider entrance between the first and second end portions and at an elevation below the high elevation. A rider is introduced through the entrance in a direction toward the first end portion such that the rider slides upward toward the first end portion while decelerating, followed by sliding travel of the rider along the predetermined path from the first end portion to the second end portion.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
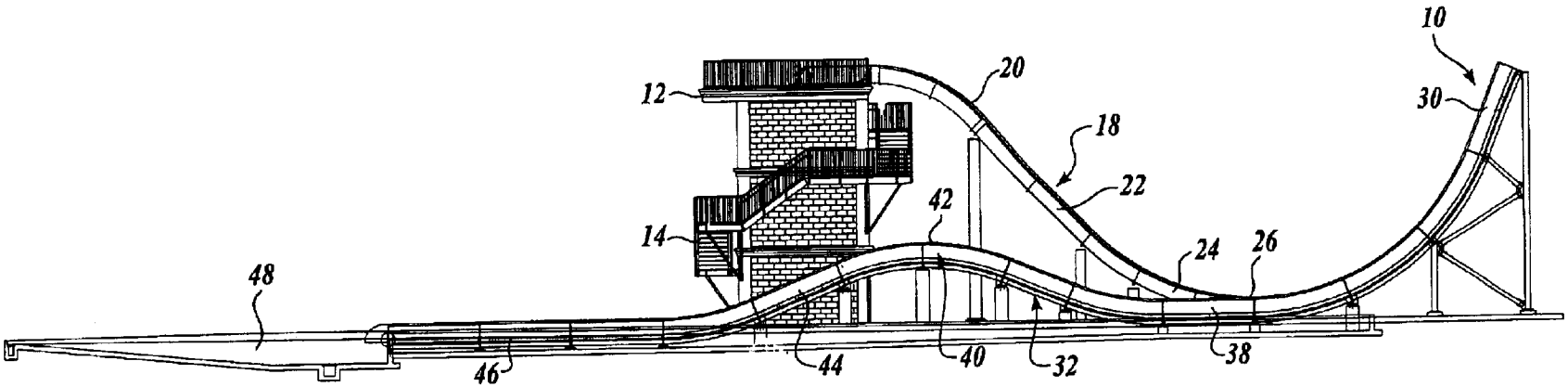
FIG. 1 is a side elevation of an undulating amusement slide in accordance with the present invention.
Figure 2:
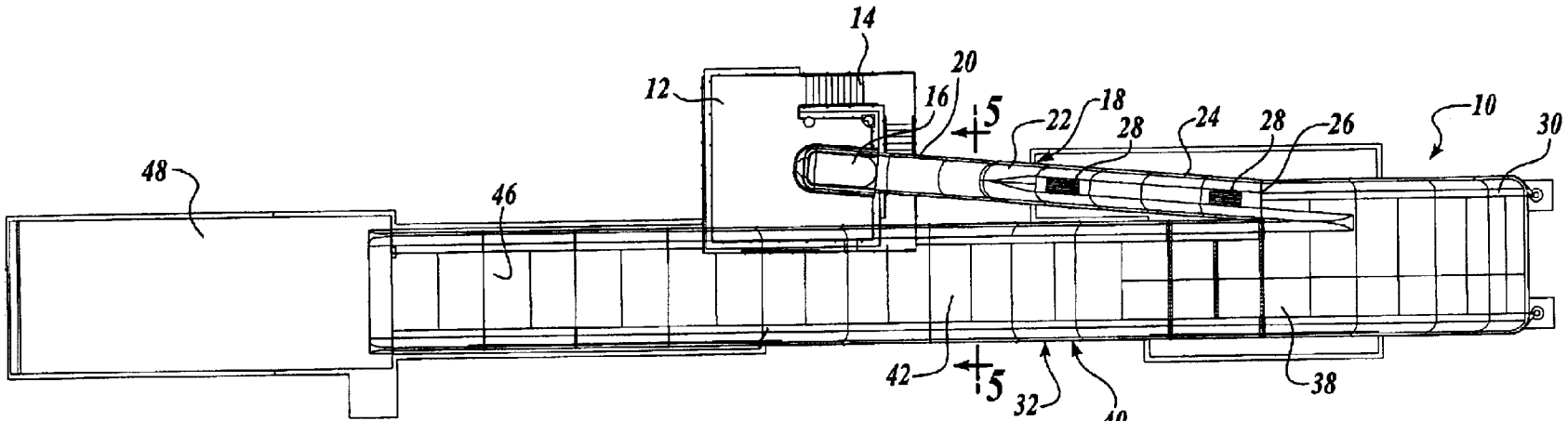
FIG. 2 is a top plan of the slide of FIG. 1.

With reference to FIG. 1 and FIG. 2, an embodiment of a slide 10 in accordance with the present invention includes an entry platform 12 at a high elevation, reachable by several flights of stairs 14. Platform 10 includes a recessed entry box

16 into which water is continuously pumped. The entry box is configured so that water overflows into a downhill "inlet slide section" or segment 18 which, for much of its length, can function as a flume. A user may slide in the flume or ride in a buoyant and resilient vehicle, such a donut-shaped, inflated inner tube, or a double "figure 8" tube having two cavities for two riders. Upright opposite sidewalls define the long, narrow, downhill path of the inlet segment.

Figure 3:
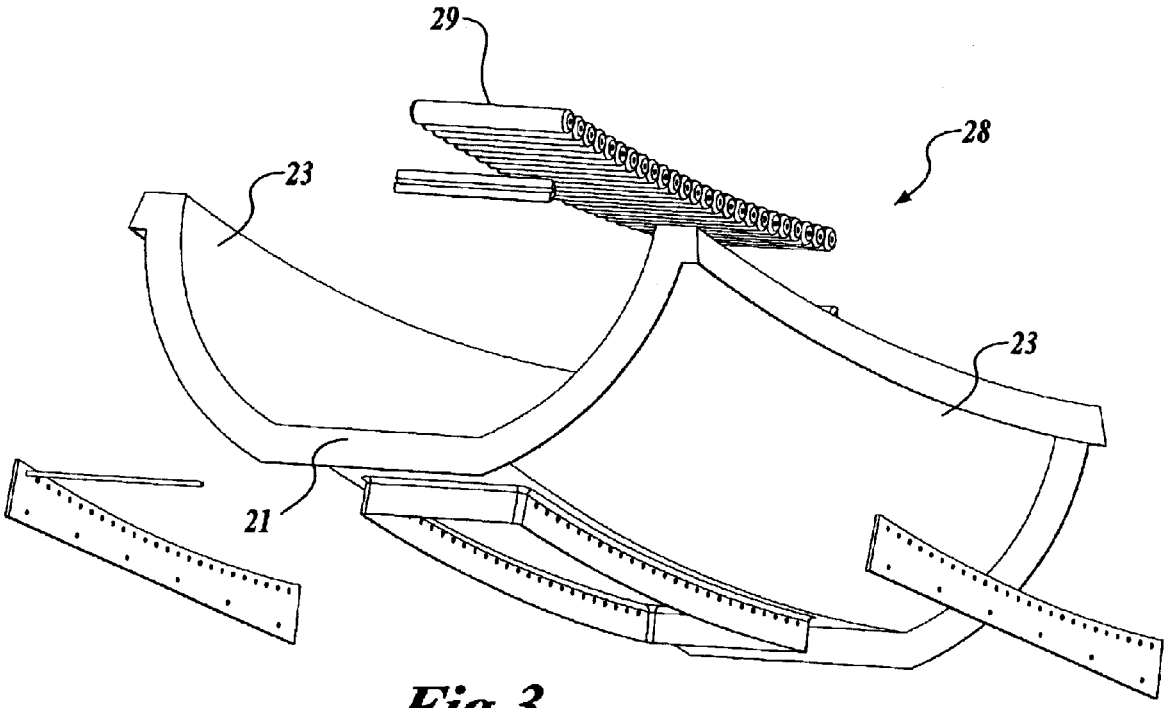
FIG. 3 is an enlarged, somewhat diagrammatic bottom perspective of a portion of the slide of FIG. 1, with parts shown in exploded relationship.
Figure 4:
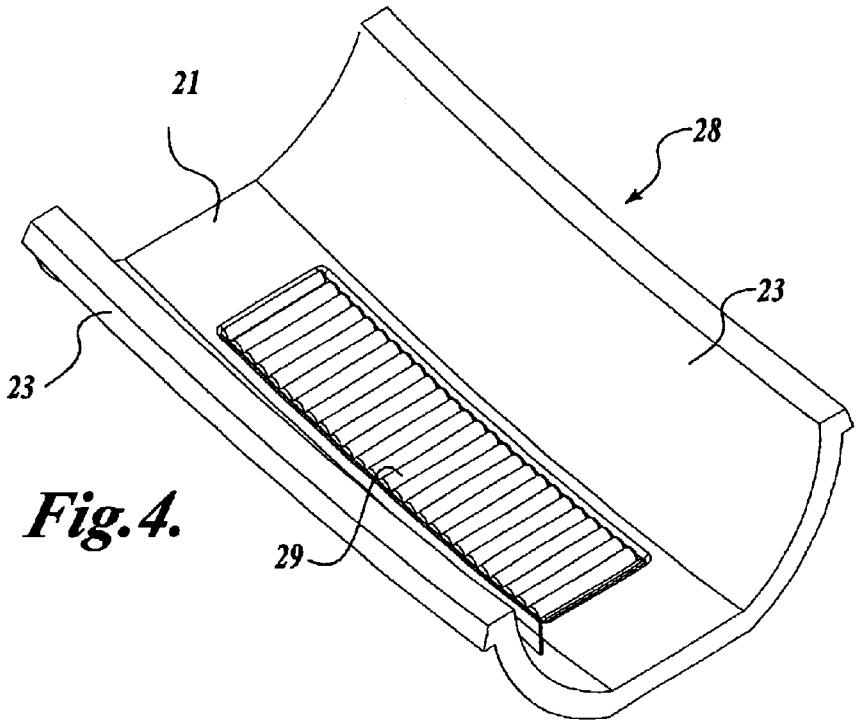
FIG. 4 is a top perspective of such portion with parts assembled.

The upper portion 20 of the inlet segment 18 is curved gradually downward to a more steeply inclined central section 22 for acceleration of the rider or riders. The central section 22 can be substantially linear, leading to the lower portion 24 which is curved oppositely from the upper portion 20 to the bottom end 26. The bottom end 26 can be approximately horizontal. In the case of an inlet segment 18 having an upper portion 20 formed as a flume and carrying a substantial volume of water introduced at the entry box 16, roller drains 28 can be provided at approximately the center and toward the of the inlet section 18. Drains of this type are illustrated in FIG. 3 and FIG. 4. These views also illustrate the general contour of the narrow inlet segment 18. The roller drain sections include an essentially flat, horizontal bottom 21 along which the rider's vehicle coasts, and curved sidewalls 23 for retaining the rider or vehicle in the flume. Rollers 29 extend transversely across the bottom and are spaced apart slightly so that water in the trough will pass between the rollers.

Returning to FIGS. 1 and 2, by the time the rider reaches the bottom 26 of the inlet section 18, he or she will be traveling at a high rate of speed along the slippery bottom surface of the flume, although by this time the slippery characteristics of the inlet section may be maintained by misting since essentially all or at least most of the water introduced from the entry box will have passed through the roller drains 28. At this point, i.e., the bottom or outlet 26 of the inlet segment (which also is the rider entrance for the next segment), the rider passes to an upwardly curved section 30 of a separate slide portion or segment 32 which also can be referred to as the "exit slide." As shown in the drawings. the surface of the exit slide is separate and distinct from the surface of the inlet section. but the exit slide at the rider opening is coextensive with the bottom portion of the inlet section. In the illustrated embodiment, the exit slide 32 is substantially wider than the inlet segment 18, allowing for unpredictable twists and turns of the rider or vehicle after it is propelled out of the inlet segment 18. The inlet segment 18 preferably enters the exit slide 32 at an angle so that the rider is propelled toward the center of the exit slide.

Figure 5:
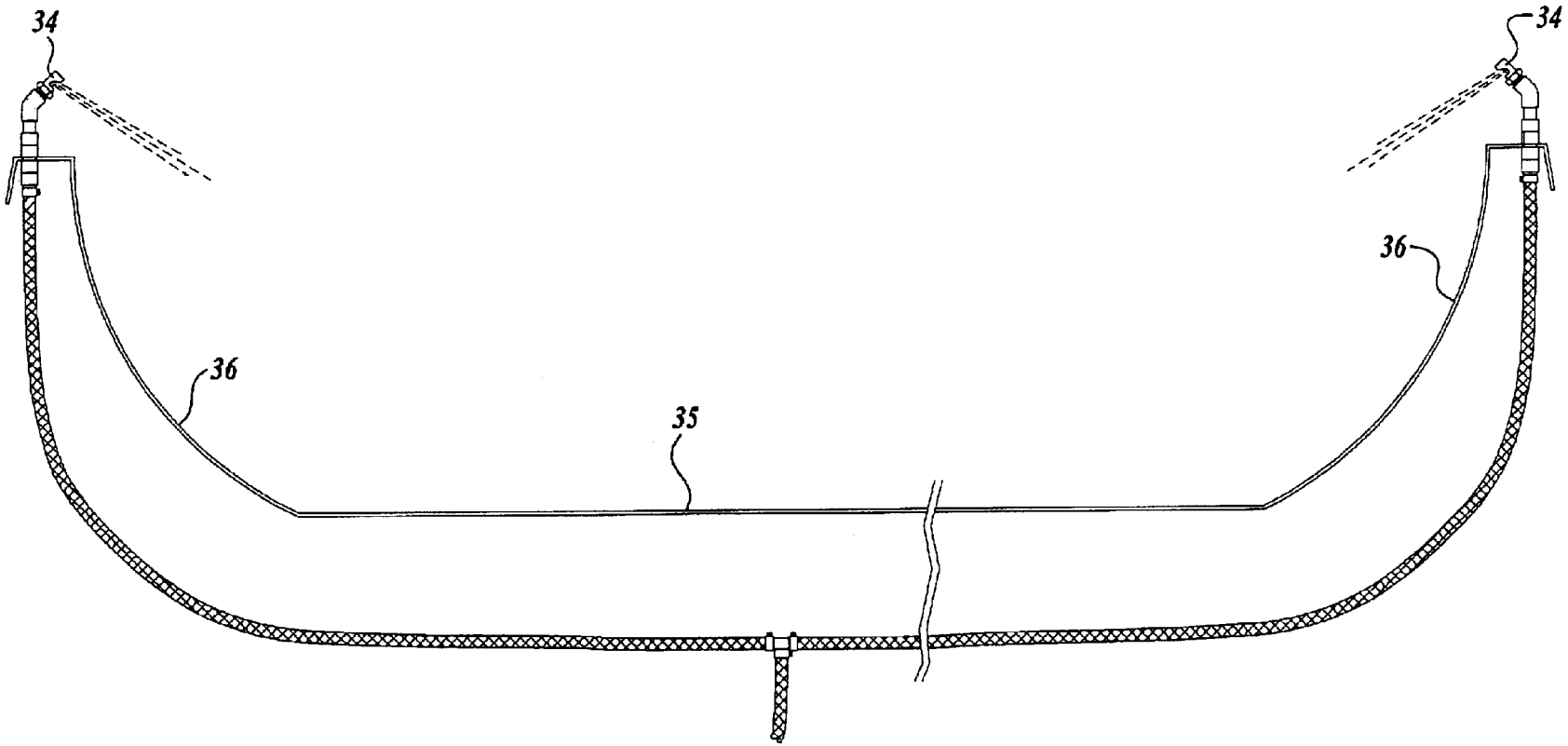
FIG. 5 is a somewhat diagrammatic, enlarged transverse section taken along line 5—5 of FIG. 2.

Upon entering the exit slide, the rider and vehicle decelerate from a high rate of speed as they transit upward along the upper curved section 30. Ultimately, the rider will travel back down along the upper curved section, past the bottom 26 of the inlet section 18. Along the entire exit slide 32, the slippery characteristics of the slide can be maintained by misting, such as by apparatus of the type shown in FIG. 5. Nozzles 34 can be spaced along the length of the slide, with some nozzles pointed inward and others more outward to lubricate the entire flat bottom surface 35 of the slide. Sidewalls 36 are provided to retain the rider and vehicle in the exit slide.

Referring to FIGS. 1 and 2, from a location close to the top of the upper curved section 30, the rider accelerates downward to a generally horizontal bottom section 38, then up and over a hill section 40 which may be designed to follow an approximate free fall parabolic path or which may result in the rider becoming airborne for a short distance after passing the top 42 of the hill. The rider then coasts along an exit section 46 which is inclined downward at a small acute angle, such as approximately 5 degrees, for maintaining a fast but safe rate of speed or slight deceleration until the rider exits the slide into an exit pool 48. The exit slide defines a separate, long, predetermined path along its length from the higher elevation toward the top of section 30 to which a rider is propelled, to the lower elevation at the exit end.

Figure 6:
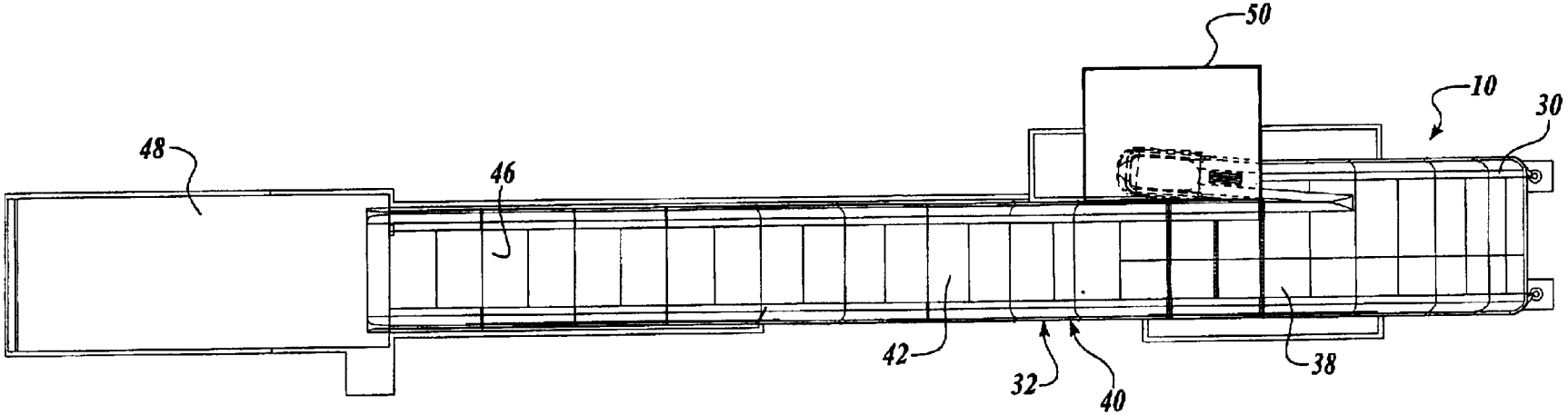
FIG. 6 is a top plan of a modified slide in accordance with the present invention.

While an embodiment of the invention has been illustrated and described, it will be appreciated that various changes can be made therein without departing from the spirit and scope of the invention. For example, the invention has been described with reference to a flume inlet section 18 for introducing the rider into the main slide 32. This also could be achieved by a misted inlet slide, in which case the drains 28 could be deleted. In another embodiment, the rider could be propelled onto the main slide 32 in a different manner. For example, with reference to FIG. 6, a mechanical acceleration component 50 could be provided to introduce the rider onto the main slide at approximately the same location and speed. The mechanical acceleration apparatus could include one or more conveyors or spring-loaded or elastic-cord members to propel one or more riders onto the main slide 32 for travel upward along the curved section 30, then downward and over the hill section 40 to an exit section 46. Similarly, the exit slide could be provided without a hill section 40, or with more than one hill, and/or with curves.

The embodiments of the invention in which an exclusive property or privilege is claimed are defined as follows:

1. An amusement device for conveying a rider comprising: a narrow, elongated inlet slide section having opposite sidewalls defining a first long, narrow, downhill path from a high elevation at a first end portion thereof to a lower elevation at a second end portion thereof, the inlet slide section having a rider entrance at its first end portion at the high elevation; and an elongated exit slide having a surface separate and distinct from the inlet slide section, the exit slide having opposite sidewalls defining a second long predetermined path along its length from a high elevation at a first end portion thereof to a lower elevation and rider exit at a second end portion thereof, the exit slide having a rider entrance opening positioned between its first and second end portions and at an elevation substantially below the exit slide first end portion, the exit slide being much wider than the narrow inlet slide section, the inlet slide section second end portion communicating through the exit slide entrance opening in a direction toward the first end portion of the exit slide, the inlet slide section and exit slide section being constructed and arranged relatively such that a rider is introduced through the exit slide entrance opening from the narrow inlet slide section onto the wider exit slide at a velocity sufficient for sliding of the rider along a portion of the exit slide upward to the first end portion for deceleration of the rider followed by travel of the rider along the long predetermined path of the exit slide.

2. The device defined in claim 1, in which the inlet slide section is curved gradually downward from its first end portion to a more steeply inclined central section for acceleration of a rider, and the inlet slide section having a lower portion adjacent to the second end portion which is curved oppositely from the upper portion of the inlet slide section.

3. The device defined in claim 1, which the second end portion of the inlet slide at the low elevation is approximately horizontal, and in which the exit slide at the entrance opening is approximately horizontal and extends coextensively with the inlet slide section.

4. The device defined in claim 1, in which the inlet slide section is angled relative to the length of the exit slide such that a rider is introduced onto the exit slide at an angle to the length of the exit slide for allowing unpredictable twists and turns of a rider after being propelled out of the narrow inlet slide section, through exit slide entrance opening and onto the first section of the wider exit slide.

5. The device defined in claim 1, in which at least an upper portion of the inlet slide section is formed as a flume and carries a substantial volume of water introduced at the entrance thereof.

6. The device defined in claim 5, in which the inlet slide includes drains between its first and second end portions for discharge of water through the inlet slide section.

7. The device defined in claim 6, in which the drains include rollers extending transversely of the inlet slide section and spaced apart for flow of water therebetween.

8. The device defined in claim 1, in which the exit slide includes a hill section, located toward the second end portion from the entrance opening, the hill section having a maximum elevation much lower than the elevation of the first end portion of the exit slide.

9. The device defined in claim 8, in which the hill section follows an approximate free fall parabolic path.

10. An amusement device for conveying a rider comprising:

an elongated exit slide having opposite sidewalls defining a long predetermined path along its length from a high elevation at a first end portion thereof to a lower elevation and rider exit at a second portion thereof, the exit slide having a rider entrance opening positioned between its first and second end portions and at an elevation substantially below the exit slide first end portion; and inlet means for introducing a rider through the entrance opening of the exit slide at an angle to the length of the exit slide in a direction toward the first end portion and at a velocity sufficient for sliding of the rider along a portion of the exit slide upward to the first end portion for deceleration of the rider followed by travel of the rider along the long predetermined path of the exit slide, the inlet means being much narrower than the exit slide and being separate and distinct therefrom, but the inlet means having a surface adjacent to the rider opening coextensive with the exit slide at a low elevation below the first end portion of the exit slide to enable unpredictable twists and turns of a rider or vehicle after it is propelled onto the exit slide as it travels upward along the first end portion.

11. The device defined in claim 10, in which the inlet means includes a downhill inlet slide section.

12. The device defined in claim 10, in which the inlet means introduces a rider approximately horizontally onto the exit slide, and in which the exit slide is approximately horizontal at the entrance opening.

13. The device defined in claim 10, in which the inlet means includes a mechanical acceleration component.

* * * * *

UNITED STATES PATENT AND TRADEMARK OFFICE

CERTIFICATE OF CORRECTION

PATENT NO. : 6,729,963 B2
DATED : May 4, 2004
INVENTOR(S) : M. Hlynka

It is certified that error appears in the above-identified patent and that said Letters Patent is hereby corrected as shown below:

Column 2,
Line 19, "the of the inlet" should read -- the bottom of the inlet --
Line 40, "drawings. the" should read -- drawings, the --
Line 41, "section. but" should read -- section, but --

Column 4,
Line 1, "1, which" should read -- 1, in which --
Line 11, "through exit" should read -- through the exit --

Signed and Sealed this

Eighth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,729,963 B2
APPLICATION NO. : 10/299585
DATED : May 4, 2004
INVENTOR(S) : Hlynka It is certified that error appears in the above-identified patent and that said Letters Patent is hereby corrected as shown below:

On the title page: Item [73] Column 1, should read -- Whitewater West Industries,Ltd.
Richmond, B.C. V6W 1J7, CANADA --

Signed and Sealed this

Thirty-first Day of October, 2006

JON W. DUDAS
*Director of the United States Patent and Trademark Office*